US006536163B1

(12) United States Patent
Monahan et al.

(10) Patent No.: US 6,536,163 B1
(45) Date of Patent: Mar. 25, 2003

(54) OPERATING CHILD SAFETY BARRIERS

(75) Inventors: Robert D. Monahan, Canton, MA (US); Antonio S. Fernandes, Fall River, MA (US); Brian D'Amelio, Maynard, MA (US); Jon R. Rossman, Chelmsford, MA (US); Thomas A. Hagerty, Somerville, MA (US); Bryan R. Hotaling, Arlington, MA (US)

(73) Assignee: First Years Inc., DE (US)

( * ) Notice: Subject to any disclaimer, the term of this patent is extended or adjusted under 35 U.S.C. 154(b) by 0 days.

(21) Appl. No.: 09/975,805

(22) Filed: Oct. 12, 2001

(51) Int. Cl.[7] ..... E05C 21/02

(52) U.S. Cl. ..... 49/465; 49/50; 292/34; 292/336.3

(58) Field of Search ..... 49/55, 50, 57, 49/463, 465, 506, 394, 395; 292/34, 36, 37, 165, 167, 336.3

(56) References Cited

U.S. PATENT DOCUMENTS

| | | | | |
|---|---|---|---|---|
| 1,416,651 | A | | 5/1922 | Lanfair |
| 1,438,202 | A | | 12/1922 | Wieland |
| 1,519,908 | A | | 12/1924 | Etue |
| 2,701,927 | A | | 2/1955 | Dyer |
| 2,851,746 | A | | 9/1958 | McPhaden |
| 2,928,146 | A | | 3/1960 | Kuniholm |
| 3,346,289 | A | | 10/1967 | Anderson |
| 3,636,683 | A | | 1/1972 | Francis et al. |
| 3,800,714 | A | | 4/1974 | Stark et al. |
| 4,139,249 | A | | 2/1979 | Hillman |
| 4,258,504 | A | | 3/1981 | Hicks |
| 4,377,303 | A | | 3/1983 | McPherson |
| 4,482,023 | A | | 11/1984 | Dziedzic et al. |
| 4,492,263 | A | | 1/1985 | Gebhard |
| 4,583,715 | A | | 4/1986 | Wright |
| 4,607,455 | A | | 8/1986 | Bluem et al. |
| 4,611,431 | A | | 9/1986 | Lauro |
| 4,669,521 | A | | 6/1987 | Barnes et al. |
| 4,677,791 | A | | 7/1987 | Larson et al. |
| 4,685,247 | A | | 8/1987 | Alam |
| 4,787,174 | A | | 11/1988 | Brown |
| 4,852,194 | A | | 8/1989 | Langan |
| 4,884,614 | A | | 12/1989 | Spurling |
| 4,944,117 | A | | 7/1990 | Gebhard et al. |
| 4,964,755 | A | * | 10/1990 | Lewis et al. ..... 404/25 |
| 5,018,302 | A | | 5/1991 | Kluge |
| 5,060,421 | A | | 10/1991 | Castelli |
| 5,076,015 | A | * | 12/1991 | Manzalini ..... 49/192 |
| 5,117,585 | A | | 6/1992 | Andrisin, III |
| 5,134,806 | A | | 8/1992 | Burkart, Jr. |
| 5,152,508 | A | | 10/1992 | Fish |
| 5,217,265 | A | | 6/1993 | Lerner et al. |

(List continued on next page.)

FOREIGN PATENT DOCUMENTS

| | | |
|---|---|---|
| GB | 2041054 | 9/1980 |
| GB | 2058186 | 4/1981 |
| GB | 2193992 | 2/1988 |

*Primary Examiner*—Jerry Redman
(74) *Attorney, Agent, or Firm*—Fish & Ricadson P.C.

(57) ABSTRACT

A child safety barrier is disclosed, including a receptacle assembly rigidly mountable to a structural element on one side of a passageway, a gate comprising a latch housing, the gate being mountable to a structural element on an opposite side of the passageway and positionable to span across the passageway, a retractable plunger assembly disposed at least partially within the latch housing and extendable from the latch housing to engage the receptacle assembly and retain the gate in a closed position, and a knob exposed at a surface of the latch housing for manipulation by an operator, the knob being movable in a first sense to a first position and movable from the first position in a second sense to cause the plunger assembly to retract from the receptacle assembly to release the gate for opening.

44 Claims, 7 Drawing Sheets

U.S. PATENT DOCUMENTS

| | | | | | |
|---|---|---|---|---|---|
| D341,207 | S | | 11/1993 | Freese et al. | |
| 5,272,840 | A | | 12/1993 | Knoedler et al. | |
| 5,360,191 | A | | 11/1994 | Carson et al. | |
| 5,367,829 | A | | 11/1994 | Crossley et al. | |
| D355,261 | S | | 2/1995 | Abrams et al. | |
| 5,396,732 | A | | 3/1995 | Andersen | |
| 5,437,115 | A | | 8/1995 | Freese et al. | |
| 5,442,881 | A | | 8/1995 | Asbach et al. | |
| 5,457,914 | A | | 10/1995 | Johnson, Jr. | |
| 5,524,994 | A | | 6/1996 | Hirano et al. | |
| 5,531,258 | A | | 7/1996 | Poulson et al. | |
| 5,533,715 | A | | 7/1996 | Dandrea | |
| 5,553,833 | A | | 9/1996 | Bohen | |
| 5,617,674 | A | | 4/1997 | Terrill | |
| 5,622,416 | A | | 4/1997 | Rainey et al. | |
| 5,657,578 | A | * | 8/1997 | Thompson | 49/141 |
| 5,657,809 | A | | 8/1997 | Longoria et al. | |
| 5,809,694 | A | * | 9/1998 | Postans | 49/57 |
| 5,890,320 | A | * | 4/1999 | Andersen | 49/465 |
| 5,911,763 | A | * | 6/1999 | Quesada | 70/120 |
| 6,016,629 | A | | 1/2000 | Sylvester et al. | |
| 6,176,042 | B1 | | 1/2001 | Rossman et al. | |
| 6,189,351 | B1 | * | 2/2001 | Eagan et al. | 70/472 |

* cited by examiner

OPERATING CHILD SAFETY BARRIERS

BACKGROUND

The invention relates to operating child safety barriers, such as those placed across the top of a staircase to prevent infants or children from wandering onto a stairway.

Child safety barriers (gates) are found across entrances at the tops of stairways in the homes of many people with infants or small children. Safety codes can require that such gates be securely fastened to structural elements on either side of the entrance on top of a stairway, rather than be held in place by pressure and friction. It is desirable that such gates be easily operated by adults, but not by small children.

SUMMARY OF THE INVENTION

The invention features a child safety gate having a latching assembly that can be engaged with a corresponding receptacle assembly, and then released by moving a single knob in two consecutivesenses, such as in a linear sense and then a rotational sense. The word "sense" is used herein to indicate a direction of motion.

In one broad aspect a child safety barrier, is disclosed that includes a receptacle assembly rigidly mountable to a structural element on one side of a passageway, a gate with a latch housing, the gate being mountable to a structural element on an opposite side of the passageway and positionable to span across the passageway, a retractable plunger assembly disposed at least partially within the latch housing and extendable from the latch housing to engage the receptacle assembly and retain the gate in a closed position and a knob exposed at a surface of the latch housing for manipulation by an operator, the knob being movable in a first sense to a first position and movable from the first position in a second sense to cause the plunger assembly to retract from the receptacle assembly to release the gate for opening. The retractable plunger assembly can include an upper plunger extendable from an upper portion of the latch housing to engage the receptacle assembly and a lower plunger extendable from a lower portion of the latch housing to engage the receptacle assembly at a point vertically spaced from the upper plunger. Both the upper and lower plungers may become operatively coupled to the knob as the knob is moved in the first sense and both the upper and lower plungers may retract as the knob is moved from the first position in the second sense. The child safety barrier may also include a plunger spring positioned between the upper and lower plungers to bias the upper and lower plungers toward a position fully extended from the latch housing. The child safety barrier may also include an adapter securely attached to the knob and a rotatable member coupled to the plunger assembly. The rotatable member may have a recess for receiving the adapter when the knob is moved in the first sense, thereby coupling the knob to the plunger assembly. The rotatable member may have a cam that rotates as the knob is moved from the first position in the second sense. The child safety barrier may also include levers pivotally mounted to pivot points, each lever having a first end in contact with the cam and a second end coupled to one of either the upper or lower plungers. Each plunger may have a slot for receiving the second end of the associated lever, and motion of each lever causes motion of the associated plunger. The contour of the cam may be such that the rotatable member is rotatable up to a particular angle, such as less than approximately 90°, or between approximately 20° and 70°, or about approximately 45° without causing any lever motion. The child safety barrier can also include a knob-spring coupled to the knob and positioned to bias the knob toward a position such that the adapter is disengaged from the recess of the rotatable member. The child safety barrier may also have a lip inside the latch housing positioned to contact the adapter when the knob is moved from the first position, in the second sense, and prevent the adapter from disengaging from recess of the rotatable member. The child safety barrier may also have a cam-spring with a first end attached to the latch housing and a second end attached to the rotatable member, the cam-spring being positioned to bias the rotatable member toward a position such that each plunger is allowed to fully extend through the latch housing. The knob may be movable in the first sense in an axial direction to the first position at least partially recessed within the latch housing. The knob may be movable from the first position in the second sense, a rotational direction. The gate may be a substantially rigid structure. The child safety barrier can also include a second, independently operable knob exposed at a side of the gate opposite the first knob. A gate swing limiter may be A; securable to the receptacle assembly to prevent swinging the gate in a particular direction, such as toward a staircase. The child safety barrier may also have a knob spring positioned to bias the knob to a position extending through an opening in the latch housing. The child safety barrier may include a coupling device rigidly secured to the knob and a rotatable plunger actuating assembly coupled to the retractable plunger assembly, wherein the coupling device engages the plunger actuating assembly when the knob is pushed in to a depressed position and the knob spring is compressed. A lip may be positioned to prevent the coupling device from disengaging from the plunger actuating assembly when the knob is turned from the depressed position. The plunger actuating assembly may include a rotatable cam having an irregular surface and a pivotal lever having a first end in contact with the cam surface and a second end coupled to a slot in the plunger assembly wherein rotation of the cam causes the lever to pivot and the plunger to move.

In another broad aspect, a method of operating a child safety barrier at a passageway is disclosed comprising rigidly mounting a receptacle assembly to a structural element on one side of a passageway, mounting a barrier comprising a latching mechanism to a structural element at a first side of the passageway and positioning the barrier to span across the passageway so the latching mechanism engages with the receptacle assembly to maintain the barrier in a closed position, pushing a knob that is coupled to the latching mechanism thereby moving the knob to a partially recessed position and turning the knob from the partially recessed position to disengage the latching mechanism from the receptacle assembly. Moving the knob to a partially recessed position may require applying between approximately three and seven pounds of force or approximately five pounds of force. Turning the knob may require applying between approximately three to seven inch-pounds of torque or approximately five inch-pounds of torque. The knob may need to be turned at least approximately 45° before the latching mechanism disengages from the receptacle assembly. The method may also include swinging the barrier to an open position by pivoting the barrier about a pivot point. The method may also include swinging the barrier to a closed position and listening for an audible click to confirm that the latching mechanism engages with the receptacle assembly. The method may include attaching a swing direction limiter to the receptacle assembly to prevent the gate from swinging open in one of the possible directions.

In yet another broad aspect, a child safety barrier includes a receptacle assembly rigidly mountable to a structural element on one side of a passageway, a gate comprising a latch housing, the gate being mountable to a structural element on an opposite side of the passageway and positionable to span across the passageway, a retractable plunger assembly disposed at least partially within the latch housing and extendable from the latch housing to engage the receptacle assembly and retain the gate in a closed position, a knob extending through an opening in the latch housing for manipulation by an operator a knob spring positioned to bias the knob to a position extending through an opening in the latch housing, a coupling device rigidly secured to the knob and a rotatable plunger actuating assembly coupled to the retractable plunger assembly. The coupling device engages the plunger actuating assembly when the knob is pushed in to a depressed position and the plunger actuating assembly rotates to retract the plunger assembly when the knob is turned from the depressed position to release the gate from the receptacle assembly for opening. A lip can be positioned inside the latch housing to prevent the coupling device from disengaging from the plunger actuating assembly when the knob is turned from the depressed position. The plunger actuating assembly can include a rotatable cam having an irregular surface and a pivotal lever having a first end in contact with the cam surface and a second end coupled to a slot in the plunger assembly. Rotation of the cam may cause the lever to fly, pivot and the plunger to move.

Implementation of the techniques and apparatus described herein may provide one or more of the following advantages. An intuitive, one hand operation latching mechanism is provided. A particular implementation includes a knob that is pushed then turned to release the latching mechanism from a mating receptacle assembly. Such an implementation may be particularly desirable because an adult carrying a child, for example, could easily open the gate with one hand, step through the passageway and re-close the gate. Since the knob has tight tolerances between parts, pinch-free operation is also provided.

Gates can typically be opened in either direction and swung to a closed and latched position. When the gate is swung to a closed and latched position, an audible click can be heard when the latching assembly engages with a mating receptacle assembly. This click provides a user with a straightforward indication that the gate properly latched when closed.

Optionally, the gate can be configured to swing open in only one direction, for example, away from a staircase. Additionally, the width of the gate is typically adjustable to fit across different sized passageways.

DETAILED DESCRIPTION OF THE DRAWINGS

Figure 1:
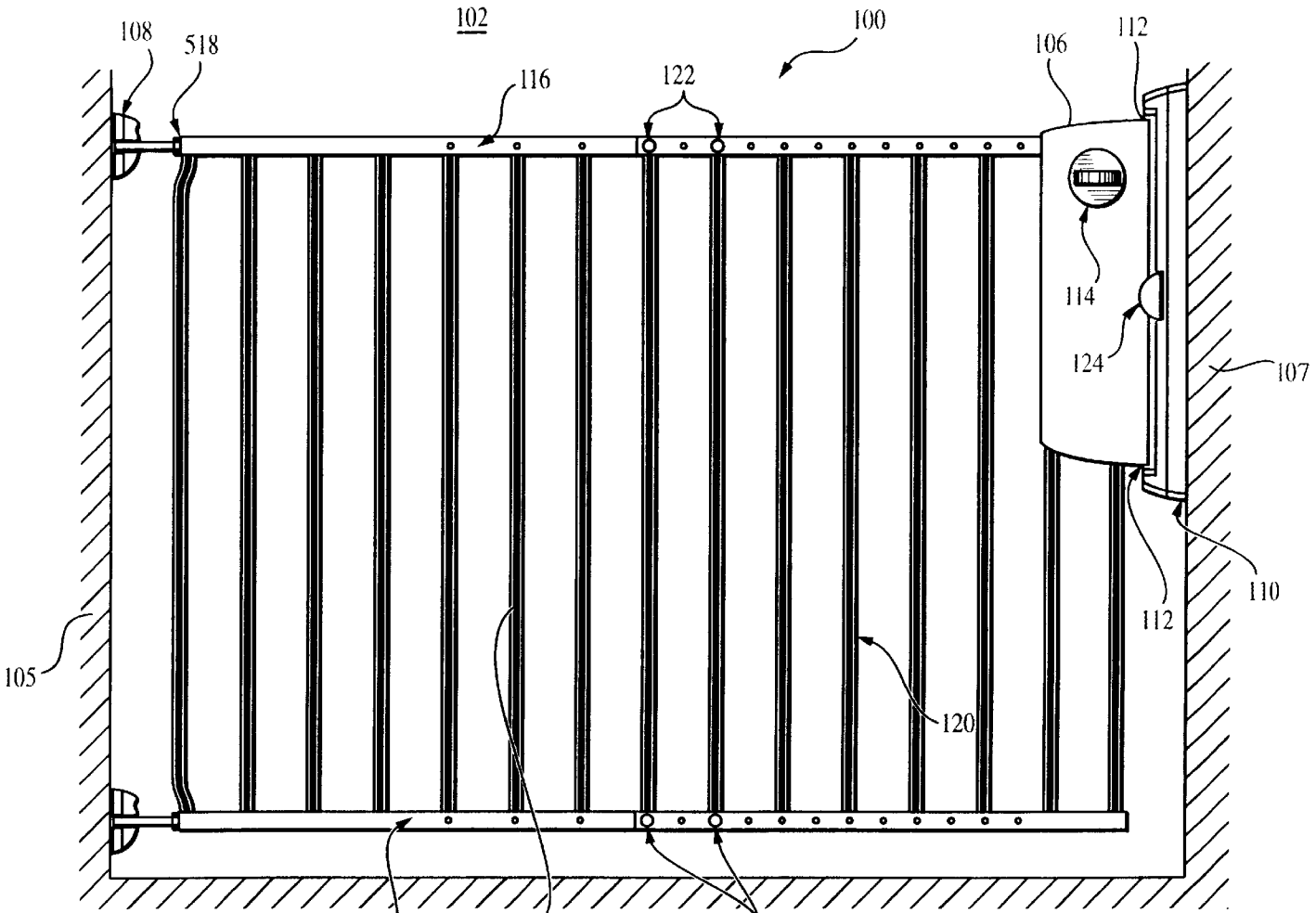
FIG. 1 is a frontal view of a particular implementation of a stair gate extended across the entrance of a stairway.

FIG. 1 illustrates a stair gate assembly 100 installed across a passageway 102 that may be, for example, at the top of a staircase. The assembly 100 includes a rigid gate 104 with a latch assembly 106, barrier mounting components 108 and a receptacle assembly 110. In the implementation shown, gate 104 is pivotally mounted to one side 105 of a passageway 102 and the receptacle assembly 110 is rigidly mounted to an opposite side 107 of the passageway 102. The gate 104 can be positioned so that it extends across the passageway 102 enabling the latch assembly 106 to mate with an associated receptacle assembly 110. So latched, the gate can prevent the passage of a child unable to operate the latch mechanism.

The latch assembly 106 includes a retractable plunger assembly 112 disposed at least partially within the latch housing 106 and extending from the latch housing 106 to engage the receptacle assembly 110 and keep the gate 104 in a closed position. A knob 114 is exposed at a surface of the latch assembly 106 for manipulation by an operator. The knob 114 is movable in a first, linear sense to an intermediate position at least partially recessed within the latch assembly 106, and then movable from the intermediate position in a second, rotational sense to cause the plunger assembly to retract from the receptacle assembly to release the barrier for opening.

In one implementation, moving the knob 114 in the first sense includes pushing the knob 114 inward to a slightly depressed position, and moving the knob 114 in the second sense includes rotating the knob about its axis of rotation, front the depressed position, through a particular number of degrees. In another implementation, the knob could include two independently movable elements that can be squeezed together and then rotated about an axis or slid to a different position. The knob may be movable in other senses or combinations of senses as well.

Gate 104 includes horizontally oriented structural elements 116, 118 extending across the top of the gate 104 and across the bottom of the gate 104, respectively, and multiple, vertically oriented structural elements 120 arranged in a substantially parallel manner. Other arrangements of structural elements and panels are generally known in the art.

Gate 104 is assembled from two panel sections connected together by securing devices that pass through holes 122. The width of the gate 104 can be adjusted by adjusting the relative positions of each panel depending on each particular situation, that is, depending on the width of a particular passageway 102.

A gate stop 124 is shown secured to the receptacle assembly 110 to prevent the gate 104 from swinging in a particular direction, such as toward a staircase. Typically, the gate stop 124 may be attached to either side of the receptacle assembly 110 to prevent opening of the gate in whichever direction a user might desire.

Figure 2:
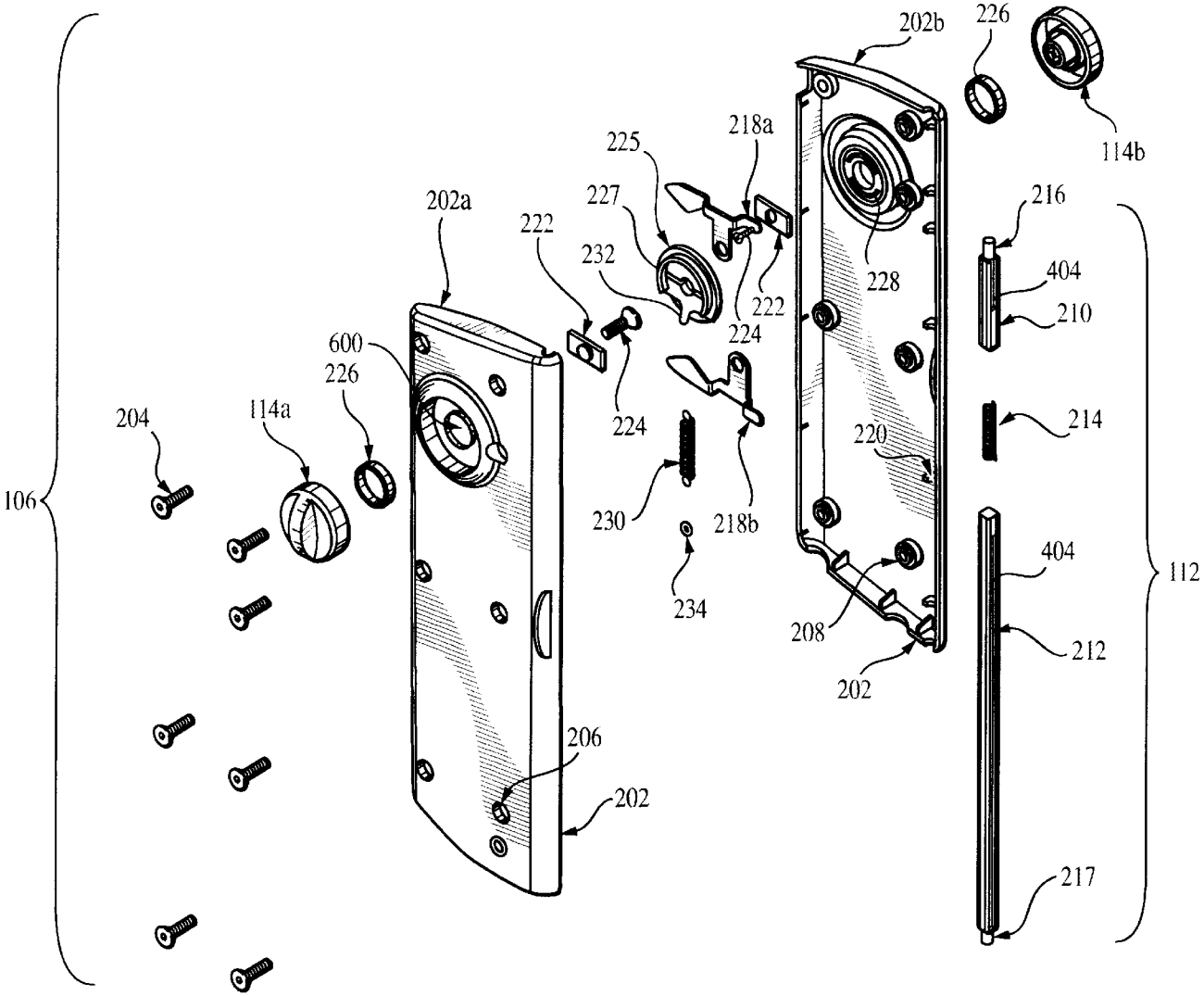
FIG. 2 is an exploded view of a particular implementation of a latch assembly.

FIG. 2 is an exploded view of the latch assembly 106 of the gate. Structurally, the latch assembly 106 includes two housing components 202*a*, 202*b* that together form a latch housing 202. Screws 204 pass through holes 206 in housing component 202*a* and thread into inserts in housing component 202*b* at points 208. The housing 202, when assembled, either contains or partially contains all other components illustrated in this figure.

The retractable plunger assembly 112 includes an upper plunger 210 axially aligned with and coupled to a lower plunger 212 by a plunger compression spring 214. Each plunger 210, 212 includes a tab 216, 217, respectively, at an end of the plunger opposite the plunger spring 214. When assembled, plunger spring 214 biases the plungers 210, 212 outwardly so that tabs 216, 217 extend through holes at the top and bottom of housing 202. Each tab 216, 217 can be pushed into housing by applying an external force and compressing spring 214. Such a force is applied, for example, when the gate is swung to its closed position, with the tabs 216, 217 engaging their corresponding receptacles. At that moment, tabs 216, 217 are momentarily depressed and then released, providing an audible latching sound as they snap into a securely latched position within the receptacles.

Each plunger assembly 210, 212 includes a notch 404 for receiving a plunger actuation lever 218*a*, 218*b*. Each actuation lever 218*a*, 218*b* is pivotal about an axis to impart a force as it pivots with respect to its respective plunger 210, 212 thereby causing axial, separating motion of the plungers. The alignment of each plunger 210, 212 is maintained within the housing 202 by guide tabs 220, which allow for axial movement of the plungers but impede significant radial movement.

A knob 114*a* is exposed at a surface of the latch housing 202 for manipulation by an operator. The knob 114*a* extends through an opening 600 in housing component 202*a*. As illustrated, this embodiment also includes an independently activatable knob 114*b* at the other side of the latch housing 104. Knob-springs 226 are positioned to bias each knob 114*a*, 114*b* to protrude at least partially through its opening in the housing 202. Each knob 114*a*, 114*b* can be manually depressed to a partially recessed position, thereby compressing the associated knob-spring 226.

A coupling device 222 is securely attached to each knob 114 with a threaded screw 224. Each coupling device 222 is, configured to rest snugly within a corresponding recess in each housing component 202*a*, 202*b*. When so positioned, the snug fit prevents inadvertent rotation of the associated knob 114 in its extended, at rest position. In order for the knob 114 to be rotated, it must first be moved in an axial direction to a partially recessed position, thereby freeing the coupling device 222 from its associated recess and enabling the knob 114 to then be rotated freely.

When the knob 114 is depressed to a partially recessed position, the coupling device 222 engages a plunger actuating assembly 225. When the coupling device 222 and the plunger actuating assembly 225 are so engaged, subsequent rotation of the knob 114 translates directly to the plunger actuating assembly 225. When the knob 114 rotates, the plunger actuating assembly 225 rotates. The plunger actuating assembly 225 includes an integral cam (not visible) that maintains contact with a portion of each actuating lever 218. Rotation of the plunger actuating assembly 225 a particular angular distance causes the corresponding levers to pivot and translate the rotational movement of the knob 114 into axial movement of the plungers 210, 212.

The plunger actuating assembly 225 includes a lip 227 positioned around at least part of the perimeter on at least one side. Lip 227 mates with a recess in the housing 202 to maintain proper positioning of the plunger actuating assembly 225.

A second lip 228 is provided at least partially around the perimeter of the inside of each opening 600 in the housing 202 where the knob 114 protrudes. When a knob 114 is depressed and partially rotated, the associated coupling device 222 rides on the lip 228, to prevent the coupling device 222 from undesirably disengaging from the plunger actuating assembly 225 until the knob 114 is rotated back to the original static angular position.

A cam spring 230 is captured at one end by a securing device 232 on plunger actuating assembly 225 and is captured at the other end by a securing device 234 that is held in place at a fixed point on housing 202. This cam spring 230 biases plunger actuating assembly 225 to a centered position where coupling devices 222 align with opening in lips 228. With the coupling devices 222 so aligned, the knob springs 226 are free to force knobs 114 (and coupling devices 222) axially outward to disengage the coupling devices 222 from plunger actuating assembly 225.

Figure 3C:
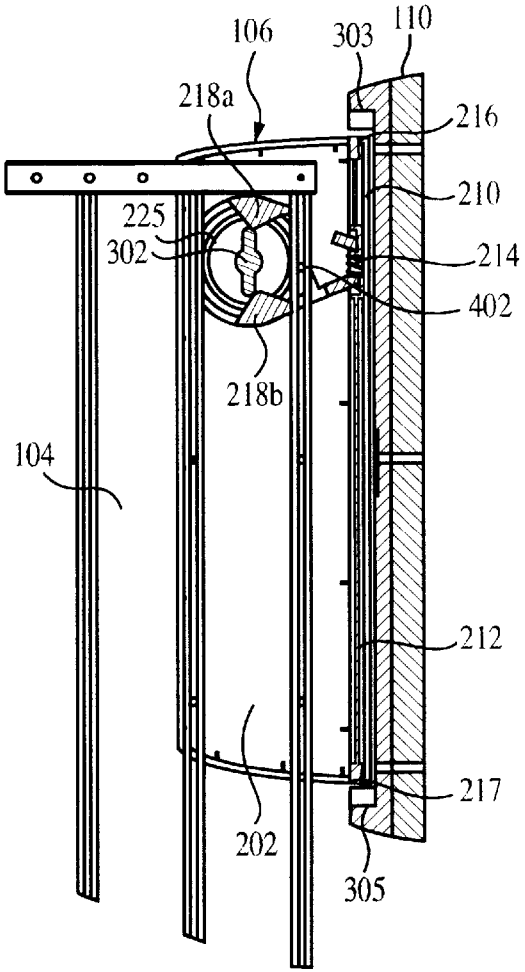
FIG. 3C is a partial cutaway view illustrating a latch assembly in a disengaged position.
Figure 3B:
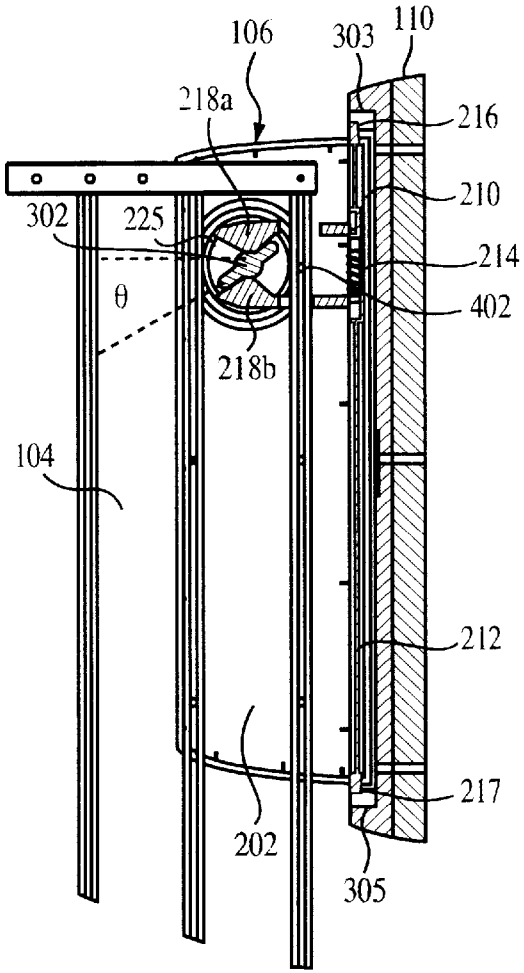
FIG. 3B is a partial cutaway view illustrating a latch assembly in a partially position actuated position.
Figure 3A:
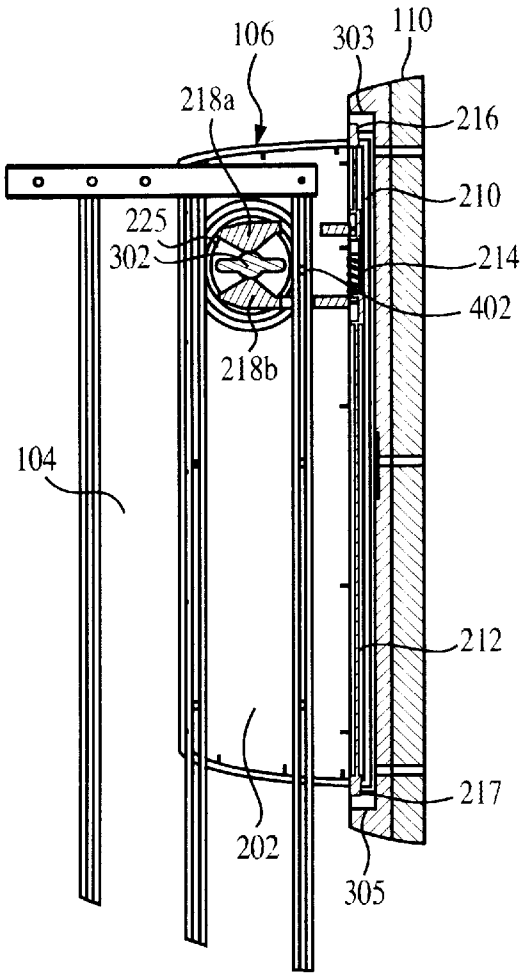
FIG. 3A is a partial cutaway view illustrating a latch assembly in a static position, engaged with a receptacle assembly.

FIGS. 3A through 3C illustrate partial cutaway views of a latch assembly 106 and receptacle assembly 110. These figures illustrate how the latch assembly 106 is disengaged from its associated receptacle assembly 110 when one of its knobs is appropriately manipulated.

FIG. 3A shows latch assembly 106 in a static position, not under the influence of any externally applied forces. Tabs 216, 217 of both upper plunger 210 and lower plunger 212 are fully extended through the holes in the housing 202, due to the force imparted by plunger spring 214. Each tab 216, 217 is securely mated to a corresponding receptacle 303, 305 in receptacle assembly 110, thereby holding gate 104 in a closed and latched position. The actuation levers 218, which are pivotal about an axis, are in contact with the cam 302 of the plunger actuating assembly 225, as shown.

Referring now to FIG. 3B, when a knob is pushed in and rotated, cam 302 also rotates. As cam 302 rotates, each actuation lever 218 maintains contact with cam 302. Because of the cam's shape, it typically can be rotated up to a particular angle θ without causing the actuation levers 218 to pivot. This "safety" angle θ is desirable to make it difficult for the latch 106 to be accidentally disengaged by an industrious child. The safely angle θ may be between about 0 degrees and 90 degrees, more preferably between about 20 degrees and 70 degrees and most preferably between about 30 degrees and 60 degrees. The greater the angle θ, the lower the likelihood that the latch assembly might be accidentally disengaged from the receptacle assembly and allow the gate to swing to an open position.

Referring to FIG. 3C, when cam 302 is rotated beyond the "safety" angle, actuation levers 218 follow the contour of the cam and begin to pivot about their common pivot point 402. Such rotation causes ends of the levers 218 near the plungers 210, 212 to impart forces on the plungers 210, 212 causing them to retract. The tabs 216, 217 are thereby retracted to disengage from their respective receptacles 303, 305 of receptacle assembly 110. The gate 104 can then be swung to an open position, allowing the operator to freely pass through the passageway.

After passing through the gate, the operator can swing the gate 104 to a closed position. The latching mechanism 106 can automatically engage the receptacle assembly 110 when the gate 104 is swung shut.

Figure 4B:
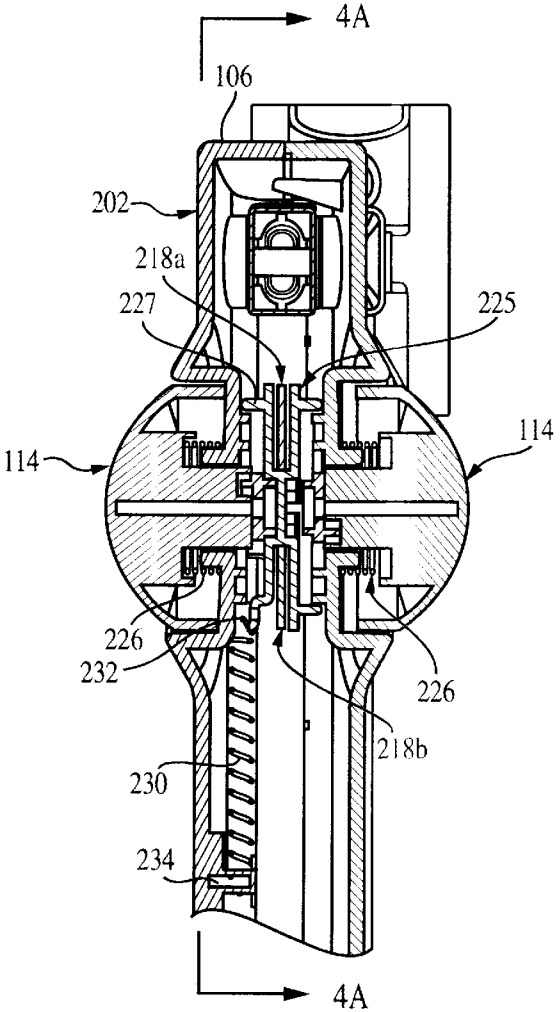
FIGS. 4A and 4B are cross-sectional views partially illustrating a latch assembly and receptacle assembly.
Figure 4A:
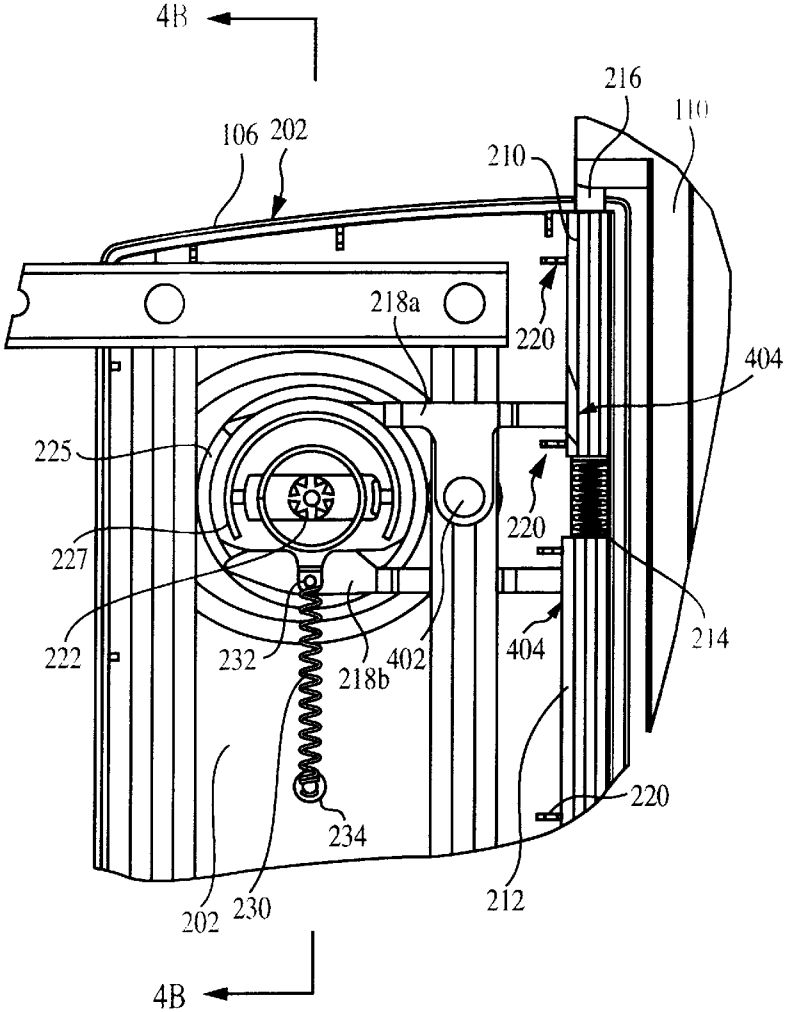

FIGS. 4A and 4B illustrate partial cutaway views of latch assembly 106 coupled to receptacle assembly, 110 looking along the passageway and looking across the passageway, respectively. Tab 216 at the end of the upper plunger 210 is shown protruding through a hole in housing 202 and engaged with a receptacle in receptacle assembly 110. Spring 214 ensures that tab 216 of upper plunger 210 remains engaged with receptacle housing 110 until the knob is pushed in and rotated. Alignment ribs 220 ensure that plungers 210, 212 maintain axial alignment relative to each other and to the holes in housing 202.

Both levers 218*a,* 218*b* are mounted to rotate about the same pivot point 402. Levers 218*a,* 218*b* each pass into a corresponding slot 404 on upper plunger 210 and lower plunger 212.

A knob 114 is exposed at either side of the latch assembly 106. Each knob 114 has an associated knob spring 226. Cam spring 230 is secured to plunger actuating assembly 225 at one end and housing 202 at the opposite end.

Figure 5:
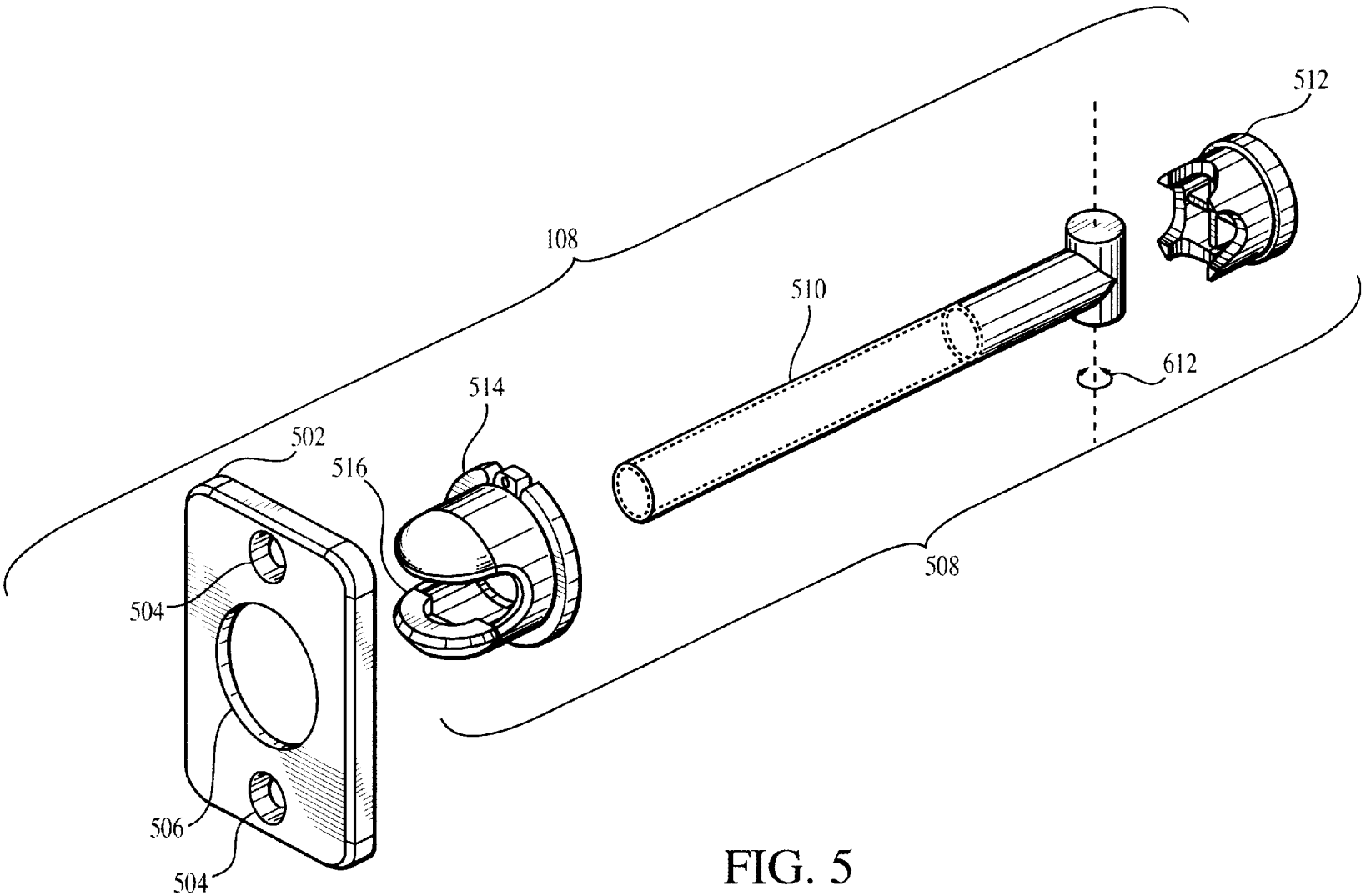
FIG. 5 is an exploded view of a pivot pin arrangement that can be used for mounting a stair gate to a wall.

FIG. 5 is an exploded view of a pivot pin assembly 108 for mounting the gate to one side of the passageway. Pivot pin assembly 108 includes a faceplate 502 with mounting holes 504 for receiving securing devices (e.g., threaded screws) for attaching the gate, for example, to a wall. Faceplate 502 also includes a primary hole 506 through which the functional elements 508 of the pivot pin assembly 108 can pass. The functional elements 508 include a pivotal rod 510 having threads at one end and a "T" element 610 at the opposite end. When assembled, "T" element 610 is captured between a support base 512 and a guide member 514, thereby enabling rod 510 to pivot about the axis 612 of "T" element 610. Guide member 514 defines a channel 516 through which rod 510 passes. The channel 516 provides a path within which the rod 510 can pivot.

The pivot pin 108 can be attached to a wall and then easily be connected to an associated stair gate. After being attached to a wall, rod 510 is rotatable about an axis parallel to the axis of its threaded portion. Therefore, the rod can easily be screwed into a threaded hole in a stair gate.

A locking nut 518 (see FIG. 1) may also be screwed onto the threaded portion of rod 510 and locked against a surface of the connected stair gate to secure the attachment.

Figure 6A:
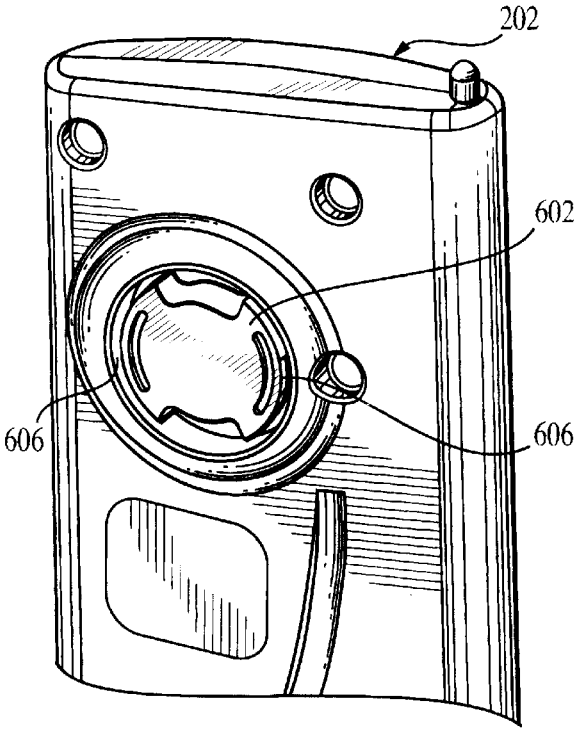
FIGS. 6A through 6C illustrate an alternative knob arrangement.
Figure 6B:
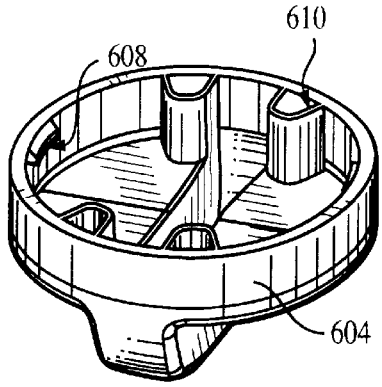

Referring now to FIGS. 6A and 6B, a gate may be factory assembled with knob adapter 602 exposed at a surface of the latch housing 202, instead of a knob. A snap-on type knob 604 may be shipped separately. A user may attach the snap-on type knob 604 to the knob adapter after receiving the package. The knob adapter 602 is flush with the surface of the latch housing 202 instead of protruding through the latch housing as the knob would, if attached. If there is no knob protruding through the surface of the latch housing 202, then the gate can be shipped inside a smaller package. This makes shipping costs less expensive. This cost savings can be quite substantial when a large quantity of stair gates is shipped.

The knob adapter 602 includes lips 606 that can capture a snap-on type knob 604 by mating with corresponding ribs 608 on the knob 604. Interlocking ribs 610 on the knob 604 mate with the knob adapter 602 to ensure that rotation of the knob 604 is directly translated to the knob adapter 602.

Figure 6C:
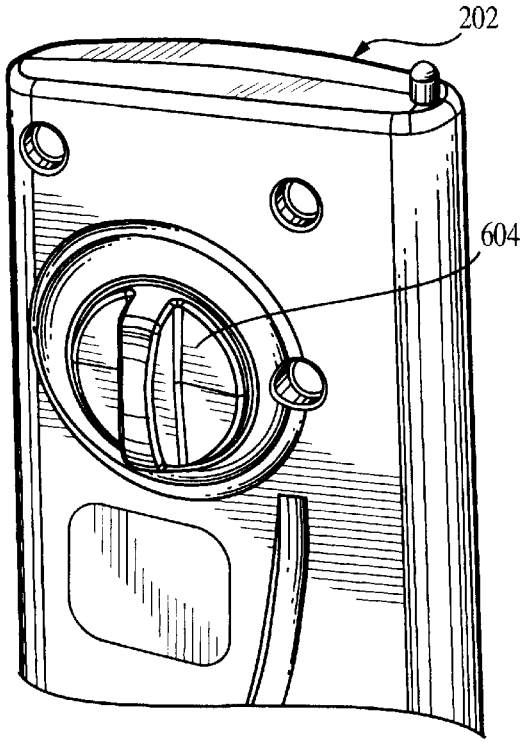

FIG. 6C illustrates a latch housing 202 with a knob 604 secured in place. Once a user attaches the knob 604 to the knob adapter 602, it cannot be removed.

FIGS. 7A through 7D illustrate an optional hinge 702 in various stages of assembly that may be used to support a stair gate as described herein. The hinge 702 includes an upper element 704, a lower element 706 and a threaded shaft 708 having an eye 710 at one end. The eye 710 can mate with a pin 712 extending from the lower element 706. The upper element 704 is slid over the lower element 706 and includes a track 714 for receiving the edges 716 of lower element 706. The edges 716 include a ramp 718 at either side of the edge near the top of the lower element 706. A notch 720 is provided near each ramp 718 to allow the ramp to flex inwardly when it slips into the mating track 714 on the upper element 704. A rib 722 is provided on each side of track 714 in the upper element 704. The rib 722 contacts the lower edge of the ramp to prevent the upper element 704 from being slid off the lower element 706 once the two elements have been mated to each other.

Figure 7A:
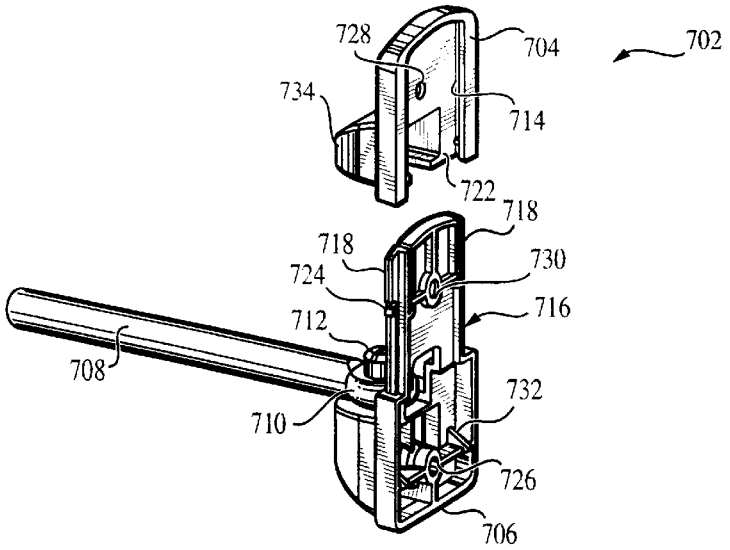
FIGS. 7A through 7D illustrate an alternative hinge arrangement.
Figure 7B:
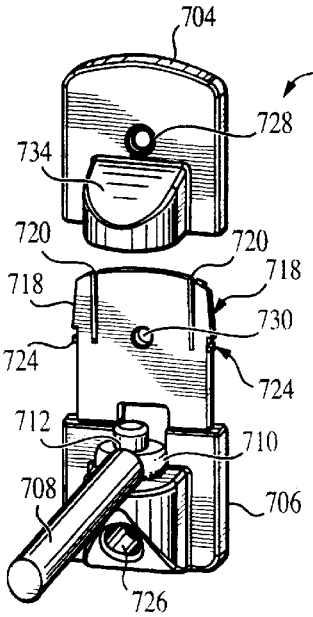
Figure 7C:
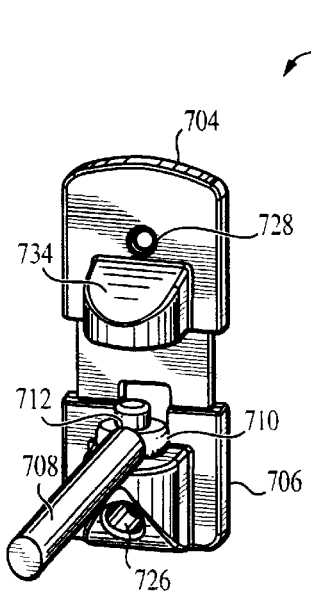

A detent 724 is provided on the edges 716 of the lower element 706 below the ramp 718. The detent 724 is positioned and sized to provide frictional resistance against the detent 724 when they contact each other. If the upper element 704 is moved from a lowered position (as its shown in FIG. 7D) to a raised position (as shown in FIG. 7C), the detent 724 contacts the rib 722 and prevents the upper element from inadvertently sliding down.

Figure 7D:
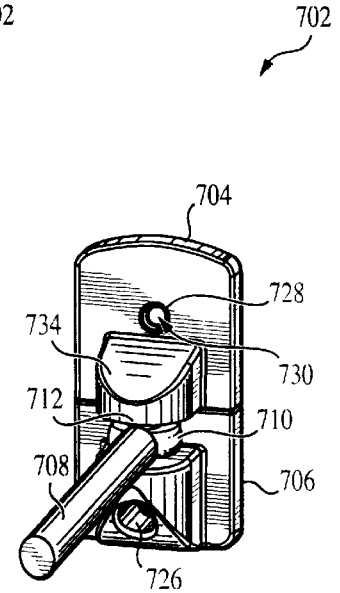

The upper element 704 may be secured to the lower element 706 at a factory prior to shipping to a user. The hinge 702 may then be shipped to a user as a single assembled structure, such as shown in FIG. 7C or 7D.

The lower element 706 includes a mounting hole 726 for receiving a securing device that can be attached, for example, to a wall for mounting. A user would typically mount the lower element 706 to the wall first. After securing the lower element 706 to a wall, the upper element 704 could be moved to a raised position, as in FIG. 7C. The threaded rod 708 could then be removed from the pin 712 and threaded into a hole in a corresponding stair gate. The gate could then be positioned so that the eye 710 of the threaded rod 708 mates with the pin 712. Next, the upper element 704 could be moved to a lowered position, as shown in FIG. 7D. The upper element 704 includes amounting hole 728 that can be aligned with a mounting hole 730 in the lower element 706. These two mounting holes must be aligned to secure the top section of the hinge 702 to a wall.

Anti-rotation ribs 732 extend a short distance from the back of the lower element 706. These anti-rotation ribs 732 dig into the wall when the lower element 706 is secured to a wall. They impede the lower element 706 from rotating when only a single securing device is being used to mount the hinge, for example, through hole 726.

The upper element 704 also includes a hood 734 that covers the pin 712 and eye 710 when the hinge is properly secured to a wall. This prevents anyone from being able to easily remove the eye 710 from the pin 712.

Various modifications to the apparatus and techniques described herein are possible. For example, the cam may have a different shape, the springs may have different tensions, the safety angle may be different, or even non-existent. Also, different movements may be required to engage the knob and different movements of the knob may be required to cause the retraction of the plunger assembly. Different hinge arrangements may be used, and different knobs may be used.

Different techniques may be utilized to connect various components to each other. Such techniques may include, for example, welding, molding, using adhesives, keying or press fitting. Additionally, the general shapes and relative sizes of the various components may vary. Many different materials may be considered suitable for manufacturing the components described herein.

Additionally, the gate could also be used to block passage of a child down a hallway or through a doorway.

Accordingly, other implementations are within the scope of the following claims.

What is claimed is:

1. A child safety barrier comprising:

a receptacle assembly rigidly mountable to a structural element on one side of a passageway;

a gate comprising a latch housing, the gate being mountable to a structural element on an opposite side of the passageway and positionable to span across the passageway;

a retractable plunger assembly disposed at least partially within the latch housing and extendable from the latch housing to engage the receptacle assembly and retain the gate in a closed position; and a knob exposed at a surface of the latch housing for manipulation by an operator, the knob moving in a first sense to a first position and then moving from the first position in a second sense, different from the first sense, to cause the plunger assembly to retract from the receptacle assembly to release the gate for opening.

2. The child safety barrier of claim 1 wherein the retractable plunger assembly comprises:

an upper plunger extendable from an upper portion of the latch housing to engage the receptacle assembly; and a lower plunger extendable from a lower portion of the latch housing to engage the receptacle assembly at a point vertically spaced from the upper plunger;

wherein both the upper and lower plungers become operatively coupled to the knob as the knob is moved in the first sense and both the upper and lower plungers retract as the knob is moved from the first position in the second sense.

3. The child safety barrier of claim 2 further comprising a plunger spring positioned between the upper and lower plungers to bias the upper and lower plungers toward a position fully extended from the latch housing.

4. The child safety barrier of claim 1 further comprising:

an adapter securely attached to the knob; and a rotatable member coupled to the plunger assembly;

wherein the rotatable member includes a recess for receiving the adapter when the knob is moved in the first sense, thereby coupling the knob to the plunger assembly.

5. The child safety barrier of claim 4 wherein the rotatable member comprises a cam that rotates as the knob is moved from the first position in the second sense.

6. The child safety barrier of claim 5 further comprising levers pivotally mounted to pivot points, each lever having a first end in contact with the cam and a second end coupled to one of either the upper or lower plungers.

7. The child safety barrier of claim 6 wherein each plunger comprises a slot for receiving the second end of the associated lever, and motion of each lever causes motion of the associated plunger.

8. The child safety barrier of claim 5 wherein the contour of the cam is such that the rotatable member is rotatable up to a particular angle without causing any lever motion.

9. The child safety barrier of claim 8 wherein the particular angle is below approximately 90°.

10. The child safety barrier of claim 8 wherein the particular angle is between approximately 20° and 70°.

11. The child safety barrier of claim 10 further comprising a cam-spring having a first end attached to the latch housing and a second end attached to the rotatable member, the cam-spring being positioned to bias the rotatable member toward a position such that each plunger is allowed to fully extend through the latch housing.

12. The child safety barrier of claim 8 wherein the particular angle is approximately 45°.

13. The child safety barrier of claim 4 further comprising a knob-spring coupled to the knob and positioned to bias the knob toward a position such that the adapter is disengaged from the recess of the rotatable member.

14. The child safety barrier of claim 13 further comprising a lip inside the latch housing positioned to contact the adapter when the knob is moved from the first position, in the second sense, and prevent the adapter from disengaging from recess of the rotatable member.

15. The child safety barrier of claim 1 wherein the first sense comprises an axial sense, and wherein in the first position the knob is at least partially recessed within the latch housing.

16. The child safety barrier of claim 1 wherein the second sense comprises a rotational sense.

17. The child safety barrier of claim 1 wherein the gate is a substantially rigid structure.

18. The child safety barrier of claim 1 further comprising a second, independently operable knob exposed at a side of the gate opposite the first knob.

19. The child safety barrier of claim 1 further comprising a gate swing limiter securable to the receptacle assembly to prevent swinging the gate in a particular direction.

20. The child safety barrier of claim 1 further comprising a knob spring positioned to bias the knob to a position extending through an opening in the latch housing.

21. The child safety barrier of claim 20 further comprising:

a coupling device rigidly secured to the knob; and a rotatable plunger actuating assembly coupled to the retractable plunger assembly;

wherein the coupling device engages the plunger actuating assembly when the knob is pushed in to a depressed position and the knob spring is compressed.

22. The child safety barrier of claim 21 further comprising a lip positioned to prevent the coupling device from disengaging from the plunger actuating assembly when the knob is turned from the depressed position.

23. The child safety barrier of claim 21 wherein the plunger actuating assembly comprises:

a rotatable cam having an irregular surface; and a pivotal lever having a first end in contact with the cam surface and a second end coupled to a slot in the plunger assembly;

wherein rotation of the cam causes the lever to pivot and the plunger to move.

24. The child safety barrier of claim 1 wherein the knob is secured to a knob adapter exposed at the surface of the latch housing prior to use.

25. A child safety barrier comprising:

a receptacle assembly rigidly mountable to a structural element on one side of a passageway;

a gate comprising a latch housing, the gate being mountable to a structural element on an opposite side of the passageway and positionable to span across the passageway;

a retractable plunger assembly disposed at least partially within the latch housing and extendable from the latch housing to engage the receptacle assembly and retain the gate in a closed position;

a knob extending through an opening in the latch housing for manipulation by an operator, a knob spring positioned to bias the knob to a position extending through an opening in the latch housing;

a coupling device rigidly secured to the knob; and a rotatable plunger actuating assembly coupled to the retractable plunger assembly;

wherein the coupling device engages the plunger actuating assembly when the knob is pushed in to a depressed position and the plunger actuating assembly rotates to retract the plunger assembly when the knob is turned from the depressed position to release the gate from the receptacle assembly for opening.

26. The child safety barrier of claim 25 further comprising a lip positioned inside the latch housing to prevent the coupling device from disengaging from the plunger actuating assembly when the knob is turned from the depressed position.

27. The child safety barrier of claim 26 wherein the plunger actuating assembly comprises:

a rotatable cam having an irregular surface; and a pivotal lever having a first end in contact with the cam surface and a second end coupled to a slot in the plunger assembly;

wherein rotation of the cam causes the lever to pivot and the plunger to move.

28. A child safety barrier comprising:

a receptacle assembly rigidly mountable to a structural element on one side of a passageway;

a gate comprising a latch housing, the gate being mountable to a structural element on an opposite side of the passageway and positionable to span across the passageway, a retractable plunger assembly disposed at least partially within the latch housing and extendable from the latch housing to engage the receptacle assembly and retain the gate in a closed position;

a knob exposed at a surface of the latch housing for manipulation by an operator, the knob being movable in a first sense to a first position and movable from the first position in a second sense to cause the plunger assembly to retract from the receptacle assembly to release the gate for opening;

wherein the retractable plunger assembly comprises:

an upper plunger extendable from an upper portion of the latch housing to engage the receptacle assembly, and a lower plunger extendable from a lower portion of the latch housing to engage the receptacle assembly at a point vertically spaced from the upper plunger; and wherein both the upper and lower plungers become operatively coupled to the knob as the knob is moved in the first sense and both the upper and lower plungers retract as the knob is moved from the first position in the second sense.

29. The child safety barrier of claim 28 further comprising a plunger spring positioned between the upper and lower plungers to bias the upper and lower plungers toward a position fully extended from the latch housing.

30. The child safety barrier of claim 28 further comprising:

an adapter securely attached to the knob; and a rotatable member coupled to the plunger assembly;

wherein the rotatable member includes a recess for receiving the adapter when the knob is moved in the first sense, thereby coupling the knob to the plunger assembly.

31. The child safety barrier of claim 30 wherein the rotatable member comprises a cam that rotates as the knob is moved from the first position in the second sense.

32. The child safety barrier of claim 31 further comprising levers pivotally mounted to pivot points, each lever having a first end in contact with the cam and a second end coupled to one of either the upper or lower plungers.

33. The child safety barrier of claim 32 wherein each plunger comprises a slot for receiving the second end of the associated lever, and motion of each lever causes motion of the associated plunger.

34. The child safety barrier of claim 31, wherein the contour of the cam is such that the rotatable member is rotatable up to a particular angle without causing any lever motion.

35. The child safety barrier of claim 34 wherein the particular angle is below approximately 90°.

36. The child safety barrier of claim 34 wherein the particular angle is between approximately 20° and 70°.

37. The child safety barrier of claim 36 further comprising a cam-spring having a first end attached to the latch housing and a second end attached to the rotatable member, the cam-spring being positioned to bias the rotatable member toward a position such that each plunger is allowed to fully extend through the latch housing.

38. The child safety barrier of claim 34 wherein the particular angle is approximately 45°.

39. The child safety barrier of claim 30 further comprising a knob-spring coupled to the knob and positioned to bias the knob toward a position such that the adapter is disengaged from the recess of the rotatable member.

40. The child safety barrier of claim 39 further comprising a lip inside the latch housing positioned to contact the adapter when the knob is moved from the first position, in the second sense, and prevent the adapter from disengaging from recess of the rotatable member.

41. The child safety barrier of claim 28 further comprising a second, independently operable knob exposed at a side of the gate opposite the first knob.

42. The child safety barrier of claim 28 further comprising:

a knob spring positioned to bias the knob to a position extending through an opening in the latch housing;

a coupling device rigidly secured to the knob; and a rotatable plunger actuating assembly coupled to the retractable plunger assembly;

wherein the coupling device engages the plunger actuating assembly when the knob is pushed in to a depressed position and the knob spring is compressed.

43. The child safety barrier of claim 42 further comprising a lip positioned to prevent the coupling device from disengaging from the plunger actuating assembly when the knob is turned from the depressed position.

44. The child safety barrier of claim 42 wherein the plunger actuating assembly comprises:

a rotatable cam having an irregular surface; and a pivotal lever having a first end in contact with the cam surface and a second end coupled to a slot in the plunger assembly;

wherein rotation of the cam causes the lever to pivot and the plunger to move.

* * * * *